United States Patent [19]

Robinson

[11] Patent Number: 4,523,787

[45] Date of Patent: Jun. 18, 1985

[54] FURNITURE CONSTRUCTION

[76] Inventor: Wilfred R. Robinson, 5197 Mitchener Rd., Sherkston, Ontario, Canada, L0S 1R0

[21] Appl. No.: 356,132

[22] Filed: Mar. 8, 1982

[51] Int. Cl.[3] ..... A47C 4/02

[52] U.S. Cl. ..... 297/440; 297/444; 297/445; 297/452

[58] Field of Search ..... 297/440, 443, 444, 452, 297/412, 414, 416, 445; 5/37 R, 12 R, 51 B; D6/67, 73

[56] References Cited

U.S. PATENT DOCUMENTS

| | | | |
|---|---|---|---|
| D. 247,398 | 3/1978 | Null et al. | D6/73 |
| 1,792,684 | 2/1931 | Ekleberry | 5/51 B |
| 2,630,858 | 3/1953 | Bellin | 297/444 |
| 2,829,707 | 4/1958 | Liebson | 155/191 |
| 3,001,822 | 9/1961 | Pagliaro et al. | 297/381 |
| 3,104,913 | 9/1963 | Faulkner et al. | 297/218 |
| 3,221,348 | 12/1965 | Siegel | 297/443 X |
| 3,380,777 | 4/1966 | Bennett | 297/440 |
| 3,414,912 | 9/1967 | Dusey, Sr. et al. | 5/52 |
| 3,563,599 | 2/1971 | Heumann | 297/218 |
| 3,709,560 | 1/1973 | Binek | 297/445 |
| 3,759,571 | 9/1973 | Korch | 297/442 X |
| 3,774,966 | 11/1973 | Faulkner et al. | 297/440 |
| 3,874,729 | 4/1975 | Blodee | 297/445 |
| 3,896,531 | 7/1975 | Gorman | 29/91.1 |
| 3,972,080 | 8/1976 | Shelloin et al. | 5/12 R |
| 4,077,517 | 3/1978 | Hilemn | 297/440 X |
| 4,165,902 | 8/1979 | Ehrlich | 297/440 |
| 4,234,976 | 11/1980 | Litkewycz | 5/18 R |

FOREIGN PATENT DOCUMENTS

| | | | |
|---|---|---|---|
| 594387 | 1/1978 | Switzerland | 297/440 |
| 756675 | 9/1956 | United Kingdom | 297/440 |
| 2026312 | 2/1980 | United Kingdom | 297/440 |

*Primary Examiner*—James T. McCall

*Attorney, Agent, or Firm*—Christel, Bean & Linihan

[57] ABSTRACT

A furniture construction for seating use which includes a rigid frame and a plurality of removable, hollow, generally rectangular members adapted to be slipped over the arm and back portions of the frame to permit quick and inexpensive removal and replacement of soiled or damaged members. Additionally, the furniture includes easily removable and replaceable front cover panels.

7 Claims, 5 Drawing Figures

Fig. 1.
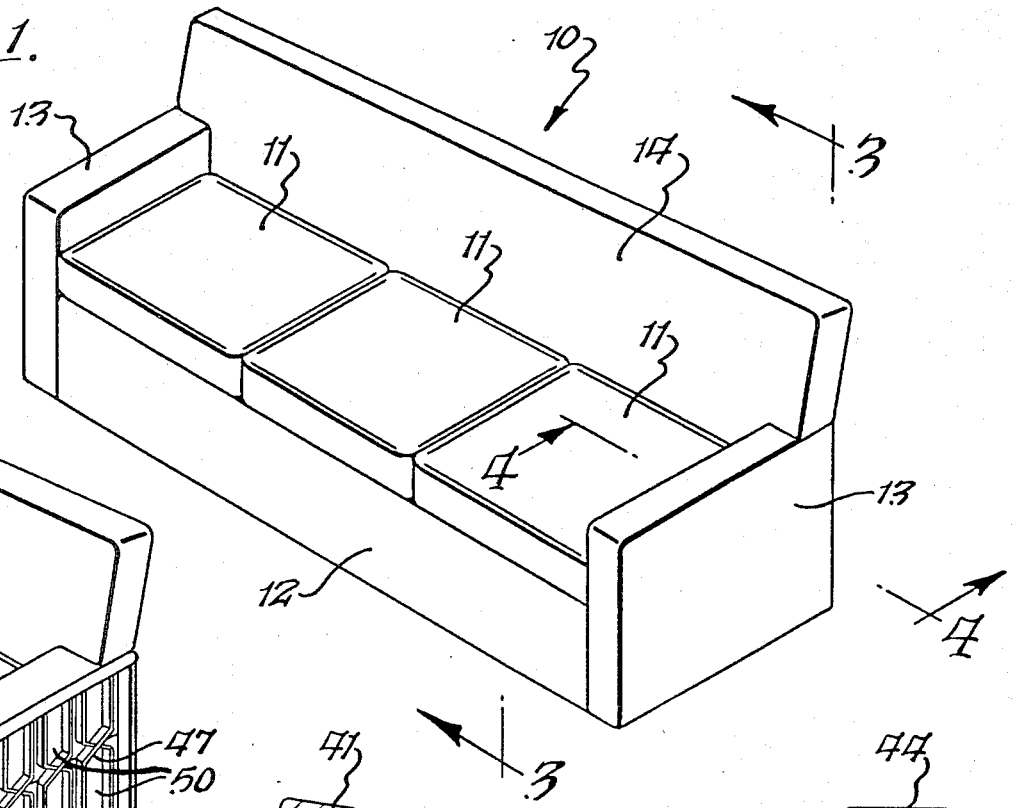
Fig. 5.
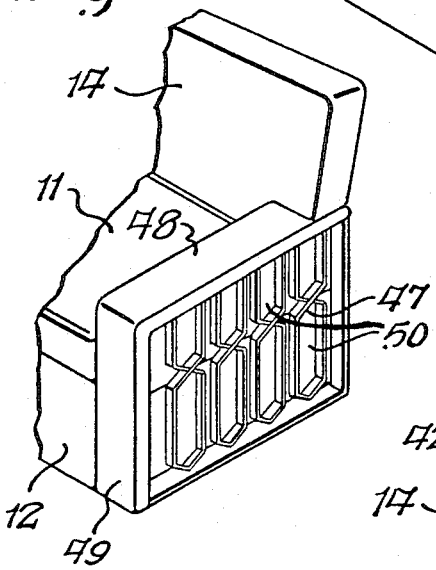
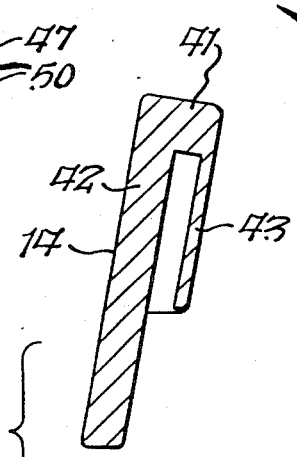
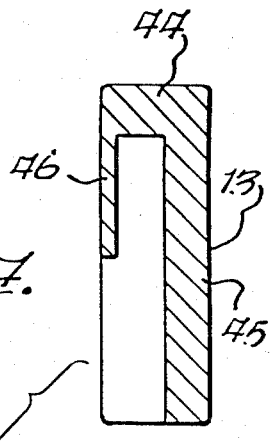
Fig. 4.
Fig. 3.
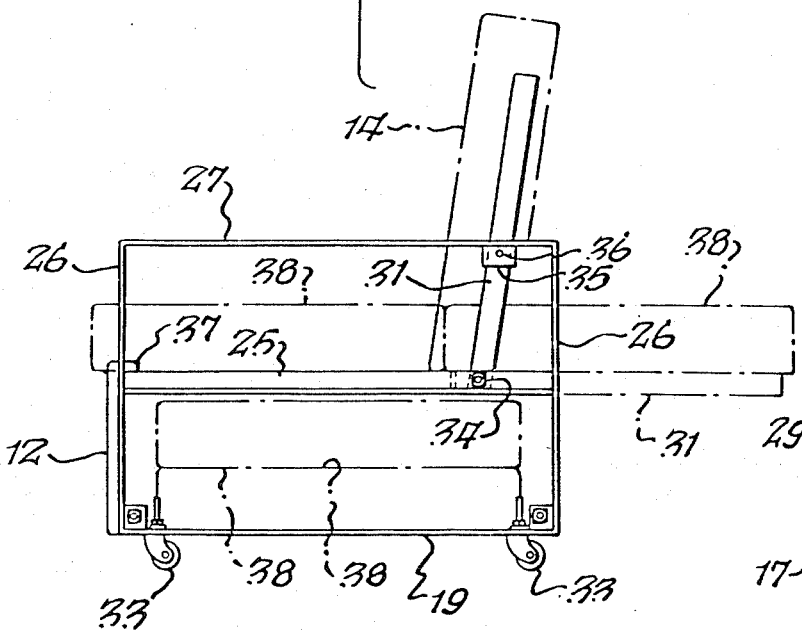
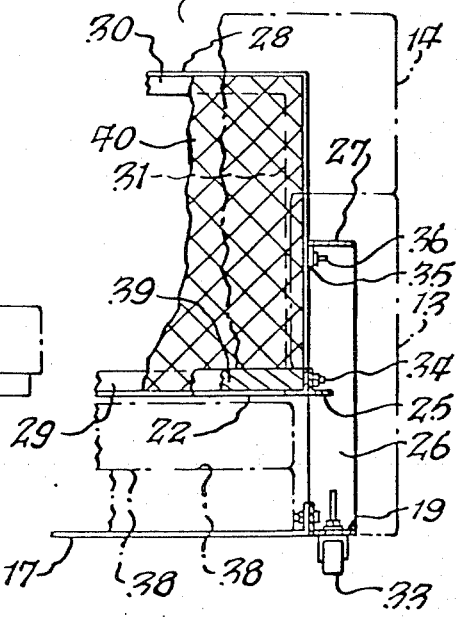

10
11
11
11
14
39
40
13
31
27
26
32
30
38
28
25
19
33
29
24
22
21
18
16
20
23
17
12
37
15
13

FURNITURE CONSTRUCTION

BACKGROUND OF THE INVENTION

This invention relates to improved furniture constructions having substantial rigidity, and more particularly to a rigid furniture construction incorporating a modular arrangement to permit the rapid replacement of damaged elements and thereby avoid the necessity to replace an entire piece of furniture in the event of damage to only a part thereof.

In those instances where furniture is utilized by the general public in public places or in places where the user remains on a relatively intermittent or short time basis, such as a hotel or motel room, a ship cabin, or the like, the propensity for damage to such furniture is substantial. Although a large number of people are careful in their use of articles owned by others and provided for use by the public, there is a substantial segment of the population which takes no pains whatsoever to make only reasonable uses of furniture in such publicly-occupied places. Furniture utilized in hotels, motels, ship cabins, and the like is frequently damaged or rapidly soiled because of the lack of care of those using it. Although the soilage problem can be overcome by the use of plastics materials, occasionally such materials are torn or cut, and repair is often difficult to conceal, the repaired furniture having an unattractive, battered appearance. When such conditions have occurred in the past, it became necessary either to replace the article of furniture or to incur substantial repair costs in order that repairs of a non-obvious nature could be made.

SUMMARY OF THE INVENTION

It is an object of the present invention to overcome the problems attendant with the prior art furniture constructions and to provide a furniture construction wherein damaged portions can be readily replaced.

It is another object of the invention to provide a furniture construction wherein major portions of the article are readily detachable from the frame and replaceable by new sections of the same kind.

It is still a further object of the present invention to provide a furniture construction wherein replacement of soiled or torn areas can be readily effected so that the furniture need not be covered with plastics materials.

Briefly stated, in accordance with one aspect of the present invention, there is provided a furniture construction for seating use which includes a rigid framework having a base frame, a seat frame, and a pair of arm frames, each of which is interconnected to provide a substantially rigid, strong framework. A pair of cross members is provided across the seat frame to support a seat, and legs for casters can be provided, as desired, to elevate the article above the level of the floor. A plurality of hollow, generally rectangular back and arm members are provided which are adapted to be slipped over the arm and back frames, respectively. A front panel member is provided to conceal the front portion of the rigid framework. Cushions can be provided which fit between the arms and extend from the back to the forward edge to complete the article.

BRIEF DESCRIPTION OF THE DRAWINGS

FIG. 1 is a perspective view of a sofa made in accordance with the present invention.

FIG. 3 is a side elevational view, partially broken away, taken along the line 3—3 of FIG. 1 and showing the side and back frame orientation for a sofa constructed in accordance with the present invention and including a movable back portion adapted to be moved so that it is substantially coplanar with the seat portion to thereby define a bed.

FIG. 4 is a fragmentary cross-sectional view taken along the line 4—4 of FIG. 1 showing a portion of an arm frame and an upholstered element in spaced relationship thereto to illustrate the method of attachment of a removable arm element to the arm frame.

FIG. 5 is a fragmentary perspective view of one end of an article of furniture constructed in accordance with the present invention showing an alternative form of arm construction incorporating an open grillwork arrangement.

DESCRIPTION OF THE PREFERRED EMBODIMENTS

Figure 2:
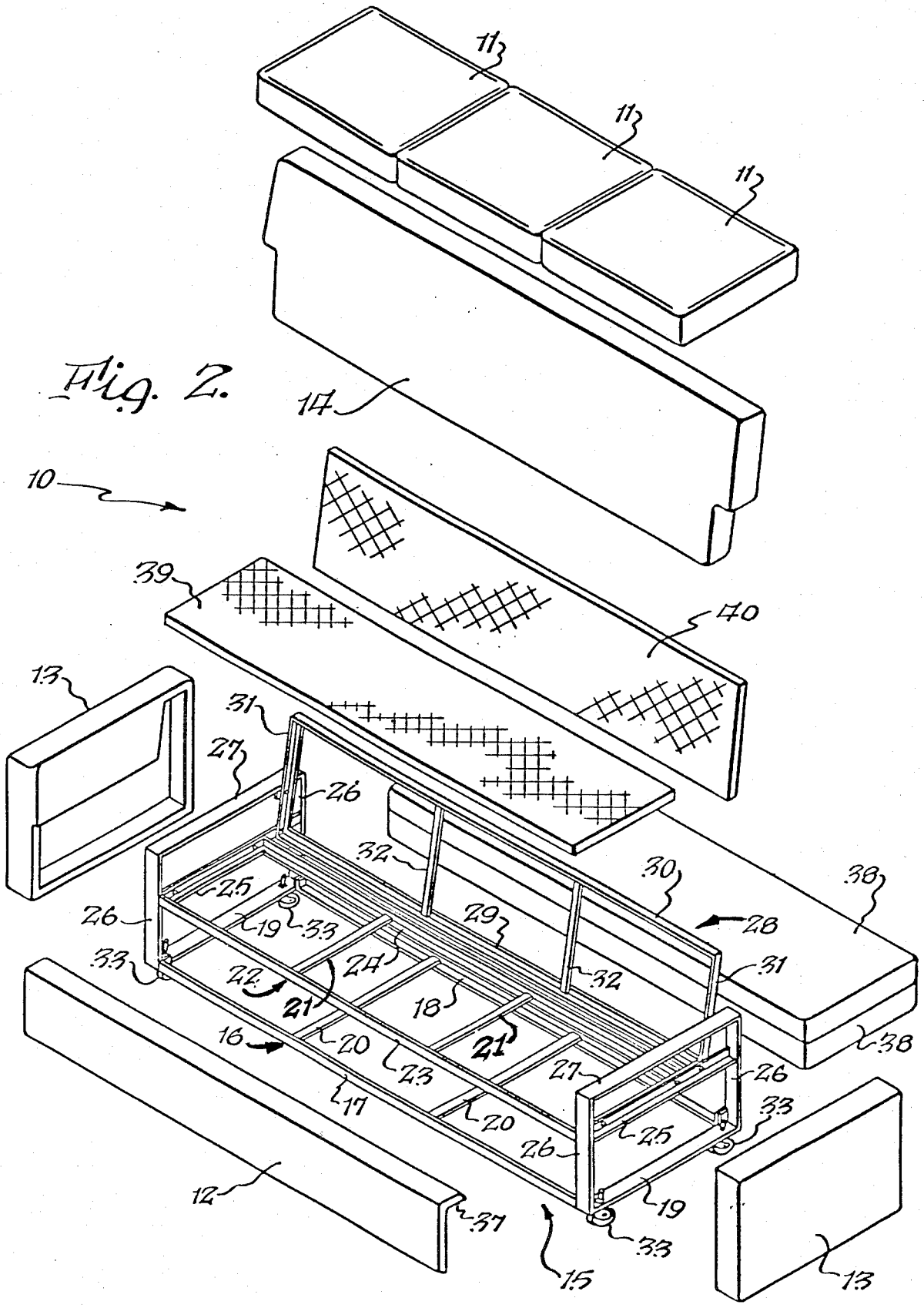
FIG. 2 is an exploded view of the sofa of FIG. 1, showing the several cover and frame elements thereof in spaced relationship.

Referring now to the drawings, and particularly to FIG. 1 thereof, there is shown an article of furniture in the form of a sofa 10. Sofa 10 includes a seat upon which a plurality of removable resilient cushions 11 can be placed, a front cover panel 12, a pair of arm members 13, and a back member 14. The external appearance of the sofa shown in FIG. 1 is conventional, although it does incorporate the features of the invention, which will hereinafter be described, and it therefore demonstrates that the present invention is such as to permit an article of furniture to be constructed which does not differ in its external, visible appearance from conventional furniture, and therefore would meet with the same degree of purchaser and user acceptance.

Referring now to FIG. 2, the various elements which comprise sofa 10 illustrated in FIG. 1 are shown in spaced relationship. Sofa 10 includes a rigid rectangular frame 15 which is preferably of metal, although other substantially rigid materials can be used, if desired. The frame 15 includes a base frame 16, a seat frame 22 and an arm frame 26,27. The base frame includes a base frame front member 17, a base frame rear member 18 spaced from and substantially parallel to base frame front member 17, and a pair of base frame end members 19, which extend between and interconnect the outer ends of base frame front member 17 and base frame rear member 18. As shown, base frame 16 is preferably rectangular, although, if desired, an arcuate or other configuration could be utilized. Several base frame cross support members 20 extending from base frame front member 17 to base frame rear member 18 are provided to support a pair of mattresses 38, or the like.

Spaced vertically upwardly from base frame 16 and in superposed relationship therewith is a similarly configured seat frame 22. Seat frame 22 includes a seat frame front member 23 and a seat frame rear member 24, seat frame front member 23 being positioned vertically upwardly from base frame front member 17, while seat frame rear member 24 is spaced inwardly of base frame rear member 18, closer to seat frame front member 23, for reasons which will hereinafter be described. A pair of seat frame end members 25 are provided which extend between seat frame front member 23 and seat frame rear member 24 and also extend rearwardly beyond seat frame rear member 24 to a length substantially equal to those of base frame end members 19. Seat frame 22 is secured in position to upstanding vertical corner members 26 of an arm frame, the corner member extending upwardly from the several corners of base frame 16. The arm frame further includes a horizontal arm frame member 27 which extends along each of the ends of frame 15 and is secured to and interconnects the respective vertical end members 26. Seat frame intermediate support elements 21 are also provided for intermediate support.

A generally rectangular back frame 28 is provided incorporating a back frame lower member 29, which extends between and is swingably secured to seat frame end members 25, and also is parallel to the front of sofa 10, and a back frame upper member 30, which is parallel to and spaced from back frame lower member 29 by means of back frame end members 31. Additionally, back frame intermediate support elements 32 are provided for intermediate support.

The several frame members which comprise base frame 16, seat frame 22, arm frame 26, 27, and back frame 28 are preferably formed from steel or other rigid metal angle members in order to provide the desired rigidity and frame integrity. The various elements are secured in the assembled form shown in FIG. 2 as by means of bolts, or any other suitable fastening devices. Additionally, as shown in FIGS. 2, 3, and 4, base frame 16 can be elevated above the floor level by means of casters 33, or, if desired, suitable legs (not shown) could be used in place of casters 33.

The orientation of back frame 28 relative to seat frame 22 and arm frame members 27 is shown in side view in FIG. 3. As shown, back lower frame member 29 is positioned between vertical corner members 26 and slightly forwardly (to the left) of the rearmost vertical corner member 26, and is interconnected with seat frame end member 25 by means of bolts 34 at each end. Bolts 34 do not rigidly secure back frame end members 31 to seat frame end members 25 but serve as pivot points whereby members 31 are pivotable about the axes defined by bolts 34, in a manner to be hereinafter described. The inclination angle of back frame 28 is fixed by the position of a depending flange 35 from arm frame member 27, the flange including an aperture to receive a positioning pin 36 carried by back frame end members 31. Positioning pin 36 preferably is of a removable nature, and operated to provide one form of a pin and socket arrangement, of which there are many types available, as will be appreciated by those skilled in the art, and which permits back frame 28 to be pivoted about bolts 34 to extend generally parallel with seat frame end members 25 as shown in dashed lines in FIG. 3. When in the position shown in dashed lines in FIG. 3, sofa 10 can function as a bed in, for example, a ship cabin, where the space available limits the number of articles of furniture which can be used. Preferably, the arrangement of the angle members defining the various frames is such that back frame members 31 rest on the portions of seat frame end members 25 which extend rearwardly of bolts 34 in order to provide support to back frame end members 31 and permit them to be positioned so that they are substantially colinear with seat frame end members 25.

Referring once again to FIG. 2, front panel 12 is provided which is adapted to be removably secured to base frame front member 17 and seat frame front member 23, as by means of bolts (not shown). An inwardly directed flange 37 is provided on front panel 12 to overlie and conceal from view seat frame front member 23. The pair of mattresses which are positioned between seat frame 22 and base frame 16 serve as bed mattresses when the sofa is utilized as a bed (see FIG. 3). The vertical spacing between base frame 16 and seat frame 22 is sufficient to accommodate two mattresses 38, which are installed and removed from the rear of sofa 10, which is not fully enclosed. The seat frame and back frame include cover panels 39, 40 which fit within seat frame 22 and back frame 28, respectively. Seat panel 39 serves to support cushions 11, and back panel 40 serves to support back member 14, which is adapted to be slidably positioned over back frame 28. Similarly, arm members 13 are adapted to slidably fit over arm frame 26, 27. Panels 39 and 40 also serve to support mattresses 38 when the sofa is converted to a bed.

The provision of a removable back member 14 and removable arm members 13 is a significant feature of the present invention, and provides the replaceable elements which can be utilized to extend the useful life of a given sofa and thereby eliminate the need for replacement of the entire sofa when but one of the panels or elements thereof has been damaged. Referring now to FIGS. 3 and 4, the general structure of back member 14 and arm members 13 is similar. As shown in FIG. 3, back member 14 includes an upper panel 41, the innermost surface of which is adapted to rest against back frame upper member 30, a front panel 42 which extends over the front of back frame 28 and its panel 40, and a rear panel 43, which can be of a smaller size than front panel 42 since it is not normally visible. Each of upper panel 41, front panel 42, and back panel 43 includes a rigid frame of plywood, or the like, which have positioned on their outer surfaces the desired padding and fabric materials to impart the desired textural and visual effects to sofa 10. Collectively, panels 41, 42, and 43 define a hollow structure which slides over and is supported by back frame 28.

Referring now to FIG. 4, there is shown a cross-sectional view of the structure of arm member 13, which, as previously noted, is generally similar to the structure of back member 14. As shown, arm member 13 includes an upper panel 44, the innermost surface of which is adapted to rest upon arm frame member 27, an outer panel 45, which depends from top panel 44 and covers the outermost ends of sofa 10, and an inner panel 46, which extends from upper panel 44 downwardly to approximately the level of seat frame 22 to substantially completely enclose the otherwise exposed inner and outer surfaces of the sofa arms. As with back member 14, each arm member 13 also includes a rigid frame of plywood, or the like, which has positioned on its outermost surfaces suitable padding and fabric to provide the desired textural and visual effects.

The exterior of sofa 10 shown and described to this juncture is rather conventional in appearance and includes a closed end at each of the arms. If desired, however, the present invention can include an open arm construction to permit the use of a decorative grillwork 47 which can impart a Mediterranean-type look to sofa 10. In the construction shown in FIG. 5, facing materials 48,49 overlie the top and front, respectively, of the arm frames 27,26, and the inner surface of each of the arm frames is preferably closed by means of inner panels 50 which obscure the seat and base frames and provides a suitable background for the grillwork arrangement.

In the course of converting sofa 10 to a bed, cushions 11 are first removed, and then positioning pins 36 for back frame 28 are retracted from depending flanges 35 to permit back frame 28 to be pivoted rearwardly to the position shown in dashed lines in FIG. 3. Back member 14 can then be removed by sliding it laterally away from sofa 10. Support for mattresses 38, which are slidably removed rearwardly from the space between base frame 16 and seat frame 22, is provided by cover panels 39 and 40. If desired, cushions 11 and back member 14 can remain in place and mattresses 38 placed directly thereupon. Reconversion from a bed to a sofa is accomplished by reversing the steps just described.

Because back member 14 and arm members 13 are removable, it can be seen that damage to one or more of those elements, or to portions thereof, can easily be corrected by merely replacing that particular element rather than the entire sofa. Additionally, should front panel 12 be damaged, it can also be replaced independently of the other portions by loosening the securing nuts, removing the old panel, and substituting a new front panel. It thus can be seen that the present invention provides a significant improvement to existing furniture structures in that it permits the quick and inexpensive replacement of individual elements of an upholstered article without the need to remove the article to a repair shop, and thus remove it from service. The present invention also permits repairs to be effected at significantly lower cost since the replaceable panels are factory made, and the repair work would, of necessity, otherwise have to be performed by a skilled upholsterer, an approach which would be considerably more expensive than the replaceable panels of the present invention.

While particular embodiments of the invention have been illustrated and described, it will be apparent to those skilled in the art that various changes and modifications can be made without departing from the spirit and scope of the invention, and it is intended to cover in the appended claims all such changes and modifications that fall within the scope of the present invention.

What is claimed is:

1. An article of furniture for seating comprising:

a rigid rectangular frame including a rectangular base frame, a rectangular seat frame, and a pair of upstanding arm frames, said base, seat and arm frames being interconnected with each other to form an enclosure with the seat frame spaced above and parallel to the base frame, and the arm frames being located at each end of the base and seat frames and rigidly secured thereto;

a normally upwardly extending rectangular back frame secured to said seat frame with the lower edge of the back frame adjacent one of the longer edges of said rectangular seat frame;

a hollow, generally rectangular back member which is adapted to be removably and slidably positioned over at least a portion of said back frame;

a pair of hollow, generally rectangular arm members, each of which is adapted to be removably and slidably positioned over at least a portion of one of said arm frames;

a removable seat in the form of a resilient cushion positioned on said seat frame and extending between said arm frames and from said back frame substantially to the forwardmost edge of said seat frame; and a removable front cover panel which is adapted to be removably positioned over the front side of said rigid rectangular frame between said base frame and said seat frame.

2. The article of furniture as set forth in claim 1 wherein said back frame has its lower edge pivotally connected to said seat frame, and wherein said back frame has an intermediate portion removably secured by removable fasteners to said arm frames, whereby said back member can be pivoted rearwardly to a position substantially coplanar with said seat frame upon removal of said removable fasteners.

3. The article of furniture as set forth in claim 2 wherein said back and seat frames each include intermediate support elements.

4. The article of furniture as set forth in claim 3 wherein said seat frame further includes a rigid cover panel overlying the intermediate support elements of said seat frame, and said back frame includes a rigid cover panel overlying the intermediate support elements of said back frame.

5. The article of furniture as set forth in claim 4 wherein said base frame includes intermediate support elements.

6. The article of furniture as set forth in claim 5 wherein said rectangular enclosure normally includes a pair of mattresses supported on the base frame intermediate support elements in superposed relationship, said mattresses being adapted to be positioned on said rigid cover panels when the back frame member is pivoted to its position where it is substantially coplanar with said seat frame.

7. An article of furniture for seating comprising:

a rigid rectangular frame including a rectangular base frame, a rectangular seat frame, and a pair of upstanding arm frames, said base, seat and arm frames being interconnected with each other to form an enclosure with the seat frame spaced above and parallel to the base frame, and the arm frames being located at each end of the base and seat frames and rigidly secured thereto;

a normally upwardly extending rectangular back frame secured to said seat frame with the lower edge of the back frame adjacent one of the longer edges of said rectangular seat frame;

a hollow, generally rectangular back member which is adapted to be removably and slidably positioned over at least a portion of said back frame;

a removable seat in the form of a resilient cushion positioned on said seat frame and extending between said arm frames and from said back frame substantially to the forwardmost edge of said seat frame;

a removable front cover panel which is adapted to be removably positioned over the front side of said rigid rectangular frame between said base frame and said seat frame;

a grillwork arrangement positioned within said arm frames and adjacent the ends of the rigid rectangular frame;

facing materials overlying the top and front of said arm frames; and inner panels disposed between said grillwork arrangement and the rigid rectangular frame to obscure the seat and base frames and provide a suitable background for the grillwork arrangement.

* * * * *